United States Patent [19]

Dundon

[11] 4,450,343

[45] May 22, 1984

[54] HIGH OUTPUT, LONG DURATION, QUICK RESPONSE, RADIANT ELECTRICAL HEATER

[76] Inventor: Gerard M. Dundon, 1353 Valley Rd., Apt. B, Wayne, N.J. 07470

[21] Appl. No.: 312,230

[22] Filed: Oct. 19, 1981

[51] Int. Cl.[3] ..... H05B 3/26

[52] U.S. Cl. ..... 219/357; 174/138 J; 219/355; 219/536

[58] Field of Search ..... 219/342, 343, 353, 354, 219/357, 548, 213, 345, 536, 537; 174/138 J; 338/283, 287, 288, 290; 373/134

[56] References Cited

U.S. PATENT DOCUMENTS

| | | | |
|---|---|---|---|
| 1,118,906 | 11/1914 | Maley | 338/287 |
| 1,479,819 | 1/1924 | Kluever | 219/357 |
| 1,526,338 | 2/1925 | Haynsworth | 219/357 |
| 1,647,346 | 11/1927 | Ehrgott | 219/536 |
| 2,673,889 | 3/1954 | Metz | 174/138 J |
| 2,723,338 | 11/1955 | Antoni | 219/342 |
| 2,857,499 | 10/1958 | Fearn | 219/354 |
| 2,927,956 | 3/1960 | Reisch | 174/138 J |
| 3,009,044 | 11/1961 | Doehler | 174/138 J |
| 3,119,924 | 1/1964 | Kueser | 338/290 |
| 3,214,572 | 10/1965 | Young | 174/138.8 |
| 3,303,324 | 2/1967 | Appleman | 219/345 |
| 3,525,850 | 8/1970 | Hager | 219/345 |
| 3,757,083 | 9/1973 | Dietz et al. | 219/356 |
| 3,956,612 | 5/1976 | Ballard et al. | 219/342 |
| 4,079,233 | 3/1978 | Meywald | 338/290 |
| 4,086,468 | 4/1978 | Keldmann | 338/283 |
| 4,100,395 | 7/1978 | Ballard | 219/345 |
| 4,262,192 | 4/1981 | Giler | 219/542 |
| 4,292,500 | 9/1981 | Semanaz et al. | 219/548 |

*Primary Examiner*—B. A. Reynolds
*Assistant Examiner*—Geoffrey S. Evans

[57] ABSTRACT

This invention provides a radiant heating apparatus utilizing a continuous wire and formed into accordion shaped strips. Three strips are shown and the ends of the strips have connecting end portions that are disposed in slots. The strips are carried in longitudinal grooves in a support member having electrical and heat insulating capability. This support is conventionally ceramic or the like and has the capability of withstanding up to thirty-two hundred degrees Fahrenheit. The wire strips are retained in the grooves by metal retaining members of conventional construction. The preferred retainer has a spring-like bias capability to retain the wire strip in the groove during heating and cooling. The apparatus is supported by a metal frame which carries the apparatus without affecting the strips and/or crossovers for a possibility of a short or hot spot. The back side of the apparatus has an electrical insulation board to prevent accidental contact with the metal wire retaining means. This heater is used in industrial applications and the high heat is to be produced rapidly and to provide a longevity to the apparatus.

5 Claims, 6 Drawing Figures

HIGH OUTPUT, LONG DURATION, QUICK RESPONSE, RADIANT ELECTRICAL HEATER

BACKGROUND OF THE INVENTION

1. Field of the Invention

With reference to the classification of art as established in and by the U.S. Patent Office the present invention pertains to the general class entitled, "Electric Heating" (Class 219) and more particularly to the subclass therein entitled, "With heater-unit housing, casing or support means" (Subclass 520) and subclasses thereunder.

2. Description of the Prior Art

Exposed heating elements using electrical energy have been known for many years. When and where radiant heating is used in commercial manufacturing steps with high temperatures, the resistance unit is conventionally supported by an insulation board or backing disposed to retain their properties at high temperatures such as thirty-two hundred degrees Fahrenheit. Recent patents have shown ribbon elements which are necessarily thin and delicate in order to provide a quick response time and for economy of material.

Ribbons with convolutions in a corrugated manner have a tendency for buckling or distortion and require supports for holding these ribbon portions to an insulation backing. Punched holes and mounting supports usually cause a reduction of the life expectancy of the ribbon element. A small indention is usually created at the support point because the heater strips expand and contract during use. This indention may and does cause the element to burn out in a relatively reduced period of time.

An infra-red heating panel is shown in U.S. Pat. No. 2,857,499 to FEARN but the continuous wire means of Applicant is not present. U.S. Pat. No. 3,119,924 to KUESER shows a heating means having a round wire heating element but the wire element is in a recess with a metal reflector and has no supported element with a securing means to an insulating panel. U.S. Pat. No. 3,525,850 to HAGER, JR. utilizes the corrugated strip above noted. U.S. Pat. No. 3,757,083 to DIETZ, et al., is like the HAGER reference as it pertains to ribbon heaters. U.S. Pat. No. 3,956,612 shows a modular concept with zone heaters and suggests a corrugated strip be used. U.S. Pat. No. 4,100,395 to BALLARD also depicts a heater with corrugated ribbons. U.S. Pat. No. 4,262,192 to GILER shows a straight wire and a suspension system carrying the wire at a distance substantially above the support insulating block.

The prior art above noted may use plural connections to actuate each heater strip. These connections may produce failure and cause excessive voltage consumption. Flat ribbons in corrugated shapes create a large target area and as a consequence residue from the product being cured or processed may drop on this strip and smolder or flame. The presence of this residue often results in deterioration or acidification of the element resulting in element failure (burn-out). Mounting pins used with ribbon elements tend to draw heat away from the point where they engage and support the element. Heating and cooling of the ribbons causes the mounting pins to work in the holes and insulation board so that elaborate securing of these pins to the back of the supporting board requires a large cavity for the ends of the pins and connecting terminals. This pin securing means creates uneven tension in the element and uneven heating. When a ribbon is lightly retained the outer face of the heater may utilize a thin ceramic support sheet which reduces the efficiency of the heater. An additional back-up insulation sheet may be required to direct the heat outward to the product although the outer cover is slower to heat and cool.

The use of sequential serpentine forming of wire into a plurality of strips is known but the device herewith shown uses only two connecting positions and these strips are carried in channels so that the strips are isulated from each other and the position of the strips are outside the retaining support so that all radiant heat is outwardly directed so that hot ends tending to cause failure are minimized.

SUMMARY OF THE INVENTION

This invention may be summarized, at least in part, with reference to its objects. It is an object of this invention to provide, and it does provide, a radiant electric heater using substantially round wire in a serpentine manner and with the lengths carried in channels formed in an insulation board. These wire lengths are deliberately positioned so as to not develop hot spots near or under the metal support frame.

It is a further object of this invention to provide, and it does provide, a radiant heater with wire heated by electrical energy to temperatures up to a maximum of thirty-two hundred degrees Fahrenheit. This wire is wound as one continuous member with connecting means provided at the ends of the wire. These wire strips are retained by very local attaching means to an insulation board and are prevented from accidently comming into contact with one another by placing the lengths in grooves formed in the insulating material. Although the metal wire element is completely exposed, the lengths are disposed to be away from the metal frame support. This placing of the heating element away from the support frame reduces drastically any hot spots in the lengths. Lengths brought to and under the frame edges have higher temperatures thereat and burnout potential is greatly increased.

High temperature up to a maximum of thirty-two hundred degrees Fahrenheit is achieved with wire using metallic alloys designed for such temperatures. An absence of protective covers is contemplated as covers delay effective heat time and use. Refractory insulation is used because of the high temperature and support holes in the insulation support accepts a determined pattern of support pins. The connection to external electrical supply is from the back of the unit and a rear insulation sheet is provided to prevent unwanted or accidental contact with the electrical circuit. This heater produces as much as seven thousand watts per square foot of exposed area.

In addition to the above summary the following disclosure is detailed to insure adequacy and aid in understanding of the invention. This disclosure, however, is not intended to cover each new inventive concept no matter how it may later be disguised by variations in form or additions of further improvements. For this reason there has been chosen a specific embodiment of high output, long duration, quick response radiant electrical heater as adopted for use in industrial applications and showing a preferred means for manufacture of said heater. This specific embodiment has been chosen for the purposes of illustration and description as shown in the accompanying drawing wherein:

BRIEF DESCRIPTION OF THE DRAWING

In the following description and in the claims various details are identified by specific names for convenience. These names are intended to be generic in their application. Corresponding reference characters refer to like members throughout the several figures of the drawing.

DETAILED DESCRIPTION OF THE DRAWING

Figure 1:
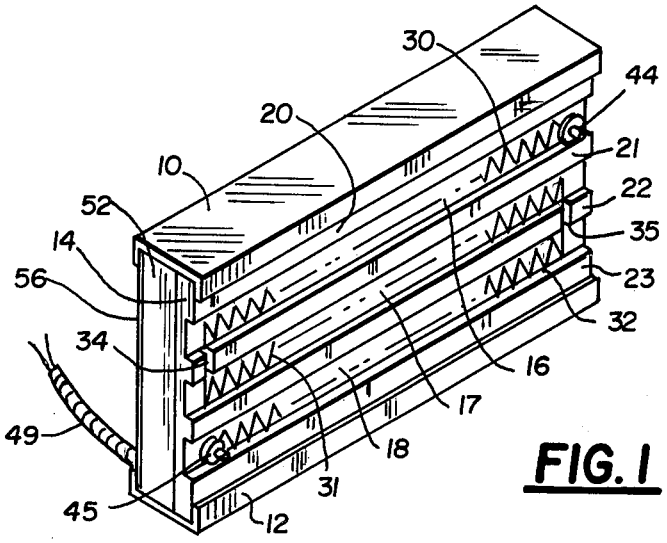
FIG. 1 represents an isometric front view of a radiant heater apparatus of this invention and showing a diagrammatic arrangement of the several components that are used therein.
Figure 2:
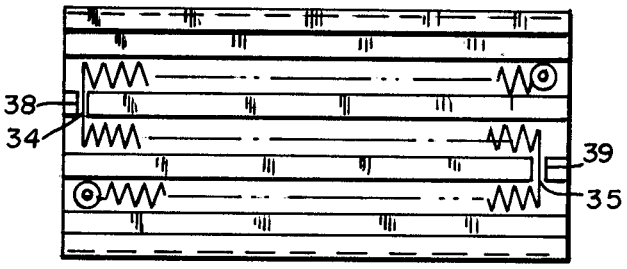
FIG. 2 represents a face or front view of the radiant heater of FIG. 1.
Figure 3:
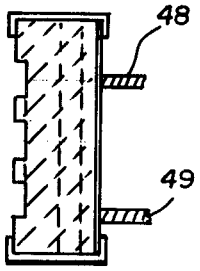
FIG. 3 represents an end view of the apparatus of FIG. 2.
Figure 4:
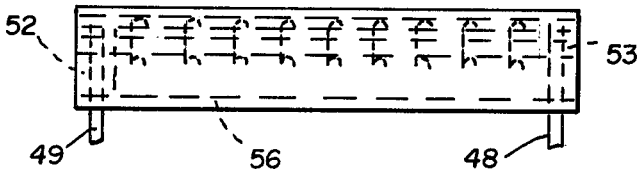
FIG. 4 represents a side view of the apparatus of FIG. 2.
Figure 6:
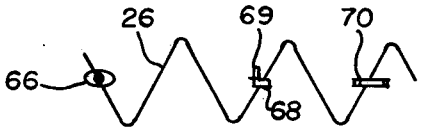
FIG. 6 represents a typical convolution or formation of the wire resistant element and showing the securing or retaining of this wire by means of pins as depicted in FIG. 5.

Referring next to FIGS. 1 through 6 there is shown a metal housing which is usually made of steel. This housing includes channel members 10 and 12 formed and/or affixed to each side of the heater. Also contemplated is making the retainer as a rectangular frame with end pieces not shown. Carried therein and retained thereby is a ceramic insulation member 14 which is rectangular in shape and formed therein is a plurality of longitudinally disposed grooves 16, 17 and 18. These grooves are of a determined width and depth and provide insulating barriers 20, 21, 22 and 23 that prevent accidental wandering of the wire elements from these grooves. A wire 26 as seen in FIG. 6 is preferably a round wire which conventianally is of alloy such as Nichrome (TM Driver-Harris Co.) and Kanthal (TM Kanthal Corp.). The size of the wire and the serpentine spacing is merely a matter of selection. Preferably the wire 26 is made into an accordion or pleated configuration with the portion of the wire at the termination of the straight slopes of the wire being formed with a radius in order to prevent cracking or undue fatiguing of the wire in the winding and the use thereof.

The ceramic insulation 14 is selected and arranged so as to withstand or accept heating elements that produce temperatures up to thirty-two hundred degrees Fahrenheit. The wire is formed into lengths 30, 31 and 32 with the wire compressed as desired or as much as is practical so as to produce the desired heating of a given area. This wire configuration is made in an accordion or serpentine arrangement to provide a heating element suitable for a uniform target area. The wire formation has end elements 34 and 35 that extend from one length to the next in order to provide a single wire arrangement and eliminate undesirable connections of the individual strips which, of course, requires connecting terminal means. The bending of the wire to go from one length to the next is accommodated by shallow channels 38-39 between the grooves and permit the wire from one ribbon to be carried from one to the next adjacent ribbon so that the entire element is one and requires only a connecting means at each of the ends of said wire element. This conductor may be posts 44 and 45 which are electrical conductors which engage the top end of the wire and extend through the insulation means to a flexible conductor diagrammatically represented as 48 and 49. A ceramic filler is provided on the underside of portion 14 and is indicated as 52 and 53. A bottom insulation board or sheet member 56 prevents accidental contact of the underside of the heater or possible contact and electrical shock with the securing pins by the operator of the heater.

Figure 5:
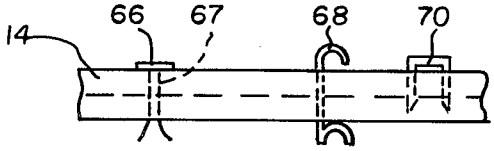
FIG. 5 represents three typical wire retaining means of metal, these retainers are readily available in industry.

In FIG. 5 there is shown three means of securing the wire 26. It is contemplated that the insulation board 14 be punched or precast with holes or means for mounting the pins in a prepositioned manner. The first type of securing means is at the left and is identified as 66. This pin is similar to a pop-type rivet in which the head is adapted to either straddle or be placed beside the wire with the legs of the rivet passing through the hole 67 and then spread slightly to retain the rivet in place.

The preferred retaining pin is a spring-type pin in which the top end is made with a hook or partial loop which engages the wire element 26. The lower end of this pin is shaped or bent to provide a spring-type foot which in the retained position for the wire creates a grip or retaining means with a slight tension or spring bias. This securing means is identified as 68 and may be passed through a slot or hole 69 and then slightly turned to engage the wire 26. Another type of securing means is a horseshoe type staple, identified as 70, which straddles wire 26 and whose legs enter into apertures in the insulation or by sharp prongs are driven into the insulation backing. All securing means are adapted to retain the wire at approximately two inch intervals so as to prevent undue bowing of the wire during heating and cooling and also to prevent the wire from creeping or otherwise distorting.

The insulation 14 is contemplated to be about two inches thick depending upon the resistance value required. This insulation is usually made of refractory material with a high voltage breaking point capable of withstanding extremely high temperatures. This insulation is formed into a rectangular shape with grooves adapted for the lengths 30, 31 and 32. The barriers 20, 21, 22 and 23 between these grooves are usually about three sixteenths of an inch wide in order to insure that the barriers or dividers prevent the wire lengths from comming into contact with one another. Conventionally the barriers or dividers run the entire length of the insulation. The insulation board 56 is usually of an insulating material. This insulating material may be attached to the metal channels 10 and 12. These channels may be attached to a backing sheet of metal now shown as by screws or spot welding. This arrangement and retention of the assembly is within the concept and scope of the designer of the particular apparatus.

The embodiment above described shows three grooves in which are mounted three strips of heating elements. The heater may have many lengths to accommodate the desired area, the length and width being a matter of selection and requirement. The securing means as shown in FIG. 5 is merely a matter of choice and economics but it is desired that the wire be secured with bias so as to prevent "hot spots" and unwanted wander and creep. The thickness of the support member 14 and the use of ceramic is a matter of industrial availability. High temperature sheet material is used to provide the needed heat resistance. The "R" factor of this sheet and the reflective ability of the heater is a matter of design.

What is novel is a heater having wire heating elements carried in grooves with separating portions that prevent wandering of the lengths into adjacent strips. The plural strips are made with connecting ends so that said wires are only connected to conductors at the two ends. The wire diameter and angle or slope of the straight legs with an adjacent leg to provide pleats or accordion shapes is a matter of design and use. The radius bend of the wire is made to accommodate the alloy, the diameter and bending capability.

Terms such as "left", "right", "up", "down", "bottom", "top", "front", "back", "in", "out" and the like are applicable to the embodiment shown and described in conjunction with the drawing. These terms are merely for the purposes of description and do not necessarily apply to the position in which the high output, long duration, quick response radiant electrical heater may be constructed or used.

While a particular embodiment of the radiant heater has been shown and described it is to be understood the invention is not limited thereto and protection is sought to the broadest extent the prior art allows.

What is claimed is:

1. A heating apparatus and mounting means for electrically energized heaters, including:

(a) a continuous wire form in which the energized elements are disposed in a generally flat and planar array and in secured condition are disposed in a plane, said wire formed into a plurality of lengths, each length wound or formed in a flat planar array and in a serpentine pattern with sloped adjacent portions disposed in substantially straight extents and with said sloped portions having a turned end portion with and including a determined radius to accommodate the wire size and convolution, each length and said serpentine pattern having the wire arranged in an accordion shaped array and with each length having at least one end disposed to provide a substantially transverse portion and connection to an adjoining and adjacent length;

(b) a support member having an electrical insulating capability with a high "R" value as a heat insulating member, said support member having the capability to retain and support electrical resistance wires when heated by current passing therethrough at and to temperatures up to thirty-two hundred degrees Fahrenheit;

(c) a plurality of substantially parallel and planar grooves formed in the outer face of the support member, each groove having a width and length sufficient to accept and freely retain the lengths of wire and having a formed depth sufficient to retain the wire below the outer surface of the support when and while the wire is mounted therein, said lengths disposed to be mounted against and to the base of the support member in said grooves, the area between grooves providing insulating ribs adapted to prevent unwanted and potential shorting of adjacent lengths of wire;

(d) a crossover groove formed in the face of said support member and adapted to accept the transverse portion of wire extending between lengths;

(e) a multiplicity of metal retaining means for engaging the wire at a selected spacing and pattern, each metal retaining means adapted to locally secure a sloped portion of a wire intermediate the end of a straight extent and to retain this serpentine patterned wire in a planar groove and against the support member so that changes of length of the wire because of heating and cooling does not cause dislocation of the retained wire in the groove and the length of wire so retained does not change as to its radiant energized heating capability, each of said retaining means carried by and secured to the support member;

(f) a metal frame adapted to retain the support member without approaching or encroaching upon the lengths of wire to increase or decrease their energizing capability;

(g) an electrical insulating member disposed to the rear of the apparatus and opposite the face of the support member, said insulating member adapted to prevent shorting and/or contact with the metal supporting means, and (h) insulated electrical conducting means disposed to engage the unconnected ends of the wire and provide means for conducting electrical energy from an external source to said wire form.

2. A heating apparatus as in claim 1 in which the support member is rectangular and is ceramic and the grooves are longitudinally disposed.

3. A heating apparatus as in claim 2 in which the grooves extend the length of the support member.

4. A heating apparatus as in claim 1 in which there is provided an additional electrical insulating member disposed apart from the grooved insulating support member so as to provide a determined space between the underside of the support member and the additional electrical insulating member.

5. A heating apparatus as in claim 4 in which the determined space is established by insulating spacer means.

* * * * *